US008278995B1

(12) United States Patent
Vu et al.

(10) Patent No.: US 8,278,995 B1
(45) Date of Patent: Oct. 2, 2012

(54) BANDGAP IN CMOS DGO PROCESS

(75) Inventors: Luan Vu, San Jose, CA (US); Elroy Lucero, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 80 days.

(21) Appl. No.: 13/005,378

(22) Filed: Jan. 12, 2011

(51) Int. Cl.
*G05F 1/10* (2006.01)

(52) U.S. Cl. ..... 327/539

(58) Field of Classification Search ..... 327/512, 327/513, 537, 539, 541
See application file for complete search history.

(56) References Cited

U.S. PATENT DOCUMENTS

| | | | | |
|---|---|---|---|---|
| 4,349,778 | A | 9/1982 | Davis | |
| 5,436,552 | A | 7/1995 | Kajimoto | |
| 5,614,816 | A | 3/1997 | Nahas | |
| 5,825,237 | A | 10/1998 | Ogawa | |
| 6,380,723 | B1 | 4/2002 | Sauer | |
| 6,894,473 | B1 | 5/2005 | Le et al. | |
| 6,958,643 | B2 | 10/2005 | Rosenthal | |
| 7,122,997 | B1 | 10/2006 | Werking | |
| 7,253,597 | B2 | 8/2007 | Brokaw | |
| 7,489,184 | B2 | 2/2009 | Pan et al. | |
| 7,710,096 | B2 * | 5/2010 | Kotchkine et al. | 323/313 |
| 7,737,769 | B2 * | 6/2010 | Deng et al. | 327/541 |
| 7,821,307 | B2 * | 10/2010 | Chellappa | 327/143 |
| 8,159,206 | B2 * | 4/2012 | Chao et al. | 323/314 |
| 2006/0038550 | A1 | 2/2006 | Nazarian | |
| 2008/0074174 | A1 | 3/2008 | Tang | |

OTHER PUBLICATIONS

A. Garimella, M. Rashid, P. Furth, Reverse Nested Miller Compensation Using Current Buffers in a Three-Stage LDO, vol. 57, No. 4, Apr. 2010, 5 pages.

* cited by examiner

*Primary Examiner* — Jeffrey Zweizig
(74) *Attorney, Agent, or Firm* — Andrew S. Viger; Wade J. Brady, III; Frederick J. Telecky, Jr.

(57) ABSTRACT

Bandgap voltage reference circuitry capable of operating at very low power supply voltages. The current source for driving the core bandgap voltage reference is implemented with insulated gate field effect transistors having low threshold voltages. Voltage clamp circuitry protects the transistors from power supply voltage variations rising above a predetermined clamp voltage. An output amplifier with output biasing circuitry having a circuit structure similar to that of the core bandgap voltage reference ensures that the bandgap reaches the intended steady state of operation.

15 Claims, 2 Drawing Sheets

BANDGAP IN CMOS DGO PROCESS

BACKGROUND

1. Field of the Invention

The present invention relates to bandgap voltage reference circuits, in a particular, to bandgap voltage reference circuits capable of operating at low power supply voltages such as within a range of 1.5-5.5 volts.

2. Related Art

As is well known in the art, reliable voltage references are required for many types of circuits an systems. In particular, such voltage references are often required to be consistent over temperature. Perhaps the most common voltage reference circuitry relies upon the bandgap of silicon. Various forms of such circuits have been designed and implemented to generate a reference voltage of 1.2 volts that is substantially constant over temperature. However, if circuits are required to operate at lower voltages, such as 1.5 volts, a bandgap voltage of 1.2 volts leaves only 0.3 volt headroom. Such little voltage headroom is often inadequate to maintain proper circuit operation.

Referring to FIG. 1, when operating at such low power supply voltages, where headroom becomes a significant problem, most existing bandgap reference circuits use a parallel architecture where a proportional to absolute temperature (PTAT) current and a base-emitter voltage (VBE), or a portion of VBE, are generated separately and combined together to produce the 1.2 volt bandgap voltage, or a divided-down voltage based on such bandgap. For example, as shown, a differential amplifier A1, in conjunction with current mirror circuitry formed by PMOS devices M0, M1, M2, M3, bipolar junction transistors Q0, Q1 and a resistor R0 provide a PTAT current via the drain electrode of PMOS device M0. Another differential amplifier A2, in conjunction with current mirror circuitry formed by PMOS devices M4, M5, M6, M7, a bipolar junction transistor Q2 and resistor R2 provide a current based on the VBE of transistor Q2 via the drain electrode of PMOS device M4. These currents combine and generate the bandgap voltage VBG across an output resistor R1.

While such a circuit architecture allows for operation at a low power supply voltage VDD, errors in the bandgap voltage VBG over temperature are nonetheless generated from the input offsets of the two amplifiers A1, A2, and mismatches within the current mirror circuits. Further, such an architecture is relatively large in size and has two separate closed loop systems (about the differential amplifiers A1, A2) that require separate compensation. While it is possible to use bandgap trimming to improve the bandgap accuracy, the circuit size will become even larger as a result and test times increase due to the trimming needed. When using low voltage devices (e.g., maximum VDS of 1.8 volts), this circuit architecture also limits the maximum power supply voltage (VDD), since PMOS devices M0, M2, M3, M4, M6 and M7 are exposed to nearly the entire VDD voltage level. Adding voltage protection circuitry in series with these devices will then add circuit complexity and limit the operation at low VDD power supply levels.

Accordingly, it would be desirable to have an improved bandgap reference circuit Architecture capable of operating at significantly reduced power supply voltages, while minimizing the number of offsets and trimming requirements.

SUMMARY

In accordance with the presently claimed invention, bandgap voltage reference circuitry capable of operating at very low power supply voltages is provided. The current source for driving the core bandgap voltage reference is implemented with insulated gate field effect transistors having low threshold voltages. Voltage clamp circuitry protects the transistors from power supply voltage variations rising above a predetermined clamp voltage. An output amplifier with output biasing circuitry having a circuit structure similar to that of the core bandgap voltage reference ensures that the bandgap reaches the intended steady state of operation.

In accordance with one embodiment of the presently claimed invention, bandgap voltage reference circuitry includes:

- first and second power supply electrodes to convey a power supply voltage;
- current mirror circuitry coupled to the first power supply electrode and responsive to the power supply voltage and a first clamped voltage by providing first and second currents;
- bandgap reference circuitry coupled between the current minor circuitry and the second power supply electrode, and responsive to the power supply voltage, the first and second currents and the first clamped voltage by providing a bandgap reference voltage; and
- first voltage clamp circuitry coupled to the first power supply electrode, the current mirror circuitry and the bandgap reference circuitry, and responsive to the power supply voltage and the first clamped voltage by preventing the first clamped voltage from exceeding a first predetermined value.

In accordance with another embodiment of the presently claimed invention, a method of providing a bandgap voltage reference includes:

- generating first and second currents in response to a power supply voltage and a first clamped voltage;
- generating a bandgap reference voltage in response to the power supply voltage, the first and second currents and the first clamped voltage; and
- preventing, in response to the power supply voltage and the first clamped voltage, the first clamped voltage from exceeding a first predetermined value.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, or one or more voltages. Within the drawings, like or related elements will have like or related alpha, numeric or alphanumeric designators.

As discussed in more detail below, bandgap voltage reference circuitry in accordance with the presently claimed invention provides a precise bandgap voltage reference for a wide range of power supply voltages in common use today, such as 1.5-5.5 volts. Such applications include Portable System Battery Chargers with a termination voltage requirement of +/−1%, low dropout (LDO) voltage regulators, switching power supplies, and other precision systems that must operate over wide ranges of power supply voltages. Such reference circuitry uses the Brokaw Architecture which allows for simple implementation and a small number of components to optimize component matching. Further, and perhaps most advantageously, such voltage reference circuitry takes advantage of low voltage threshold PMOS devices (e.g., VTP=0.44 volt, VDS=1.8 volts) to address the low voltage headroom issue. Component matching is included and circuit startup is reliable and operates over a wide range of power supply voltages and rise times (e.g., 1 microsecond-10 milliseconds).

Figure 1:
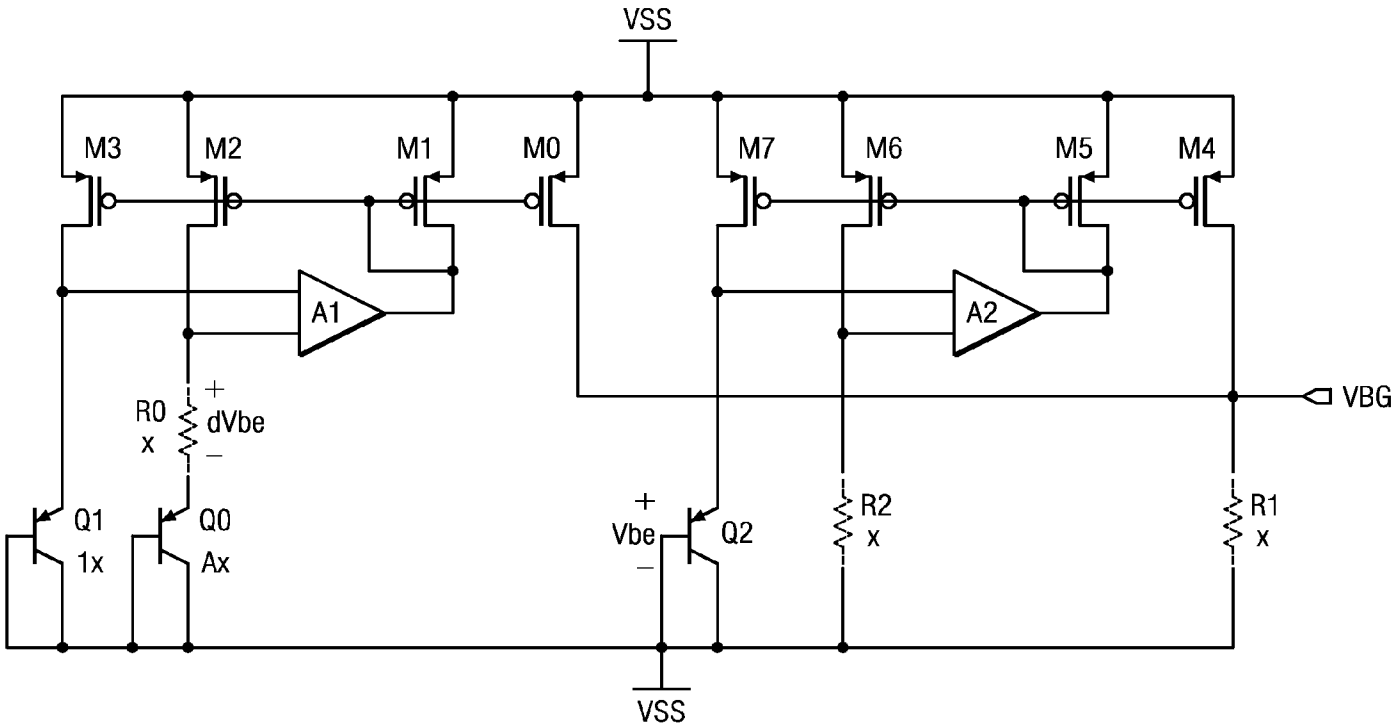
FIG. 1 (PRIOR ART)
FIG. 1 is a schematic diagram of a conventional bandgap reference circuit using a parallel circuit architecture.
Figure 2:
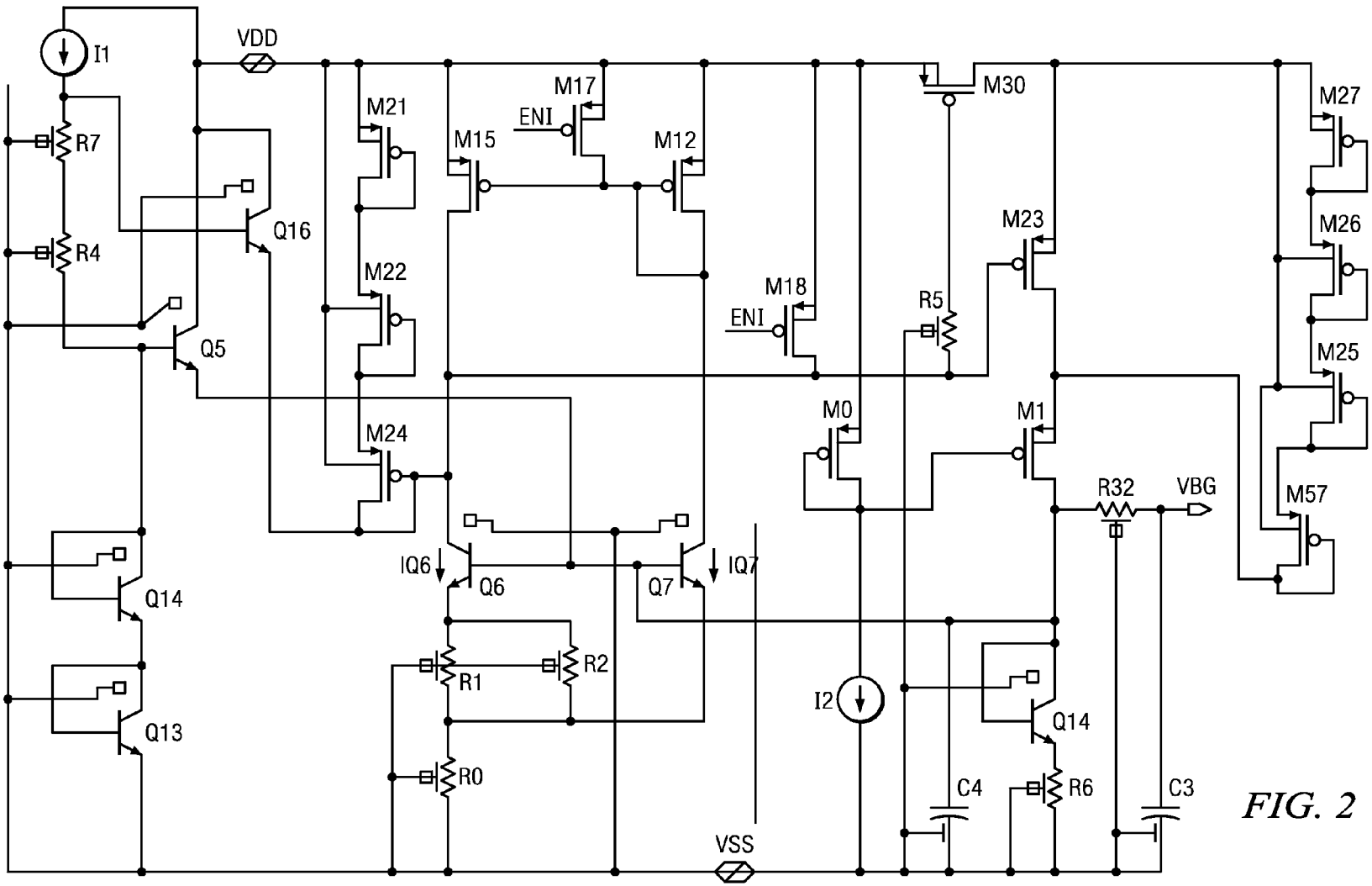
FIG. 2 is a schematic diagram of a bandgap voltage reference circuit in accordance with one embodiment of the presently claimed inventions.

Referring to FIG. 2, a bandgap voltage reference circuit in accordance with an exemplary embodiment of the presently claimed invention can be implemented as shown and described herein. In accordance with the Brokaw Architecture, bipolar junction transistors Q6 and Q7, with an emitter area ratio of Q6:Q7=14:1, establish the differential base-emitter voltage Vbe, with their respective emitter currents IQ6 and IQ7 conducted through the parallel combination of resistors R1 and R2 and resistor R0. Dual emitter resistors R1, R2 for transistor Q6 are used to allow smaller size resistors to be used while still achieving the same equivalent resistance needed for the proper ratio as compared to resistor R0.

The magnitudes of these currents IQ6, IQ7 are ensured as being equal by the current mirror action of PMOS transistors M12 and M15. In accordance with an exemplary embodiment, these transistors M12, M15 have channel width-to-length ratios of 55:8 microns, and are biased at approximately 150 millivolts overdrive voltage for optimal matching. The operating voltage Vds across the drain and source electrodes of these transistors M12, M15 is limited to their maximum safe operating voltage of 1.8 volts by a voltage clamp circuit formed by diode-connected PMOS transistors M21, M22, M24 connected between the positive power supply voltage VDD and the drain electrode of current mirror transistor M15.

While unnecessary when the circuit is operating at a very low power supply voltage (e.g., VDD=1.5 volts), such voltage clamp circuitry prevents the drain-source-to voltages Vds across current mirror transistors M15 and M12 from exceeding their maximum operating voltage (e.g., 1.8 volt) when the circuit is operating at a higher power supply voltage (e.g., 1.8-5.5 volts).

Transistor Q5, diode-connected transistors Q13 and Q14, resistors R4 and R7 and a current source I1 form a startup circuit which initiates current flow through the current mirror circuit M12, M15. This start-up circuit shuts down once circuit operation has begun, due to the resulting inadequate base-emitter drive voltage for transistor Q5 (Vbe=1.4 volts-1.2 volts=0.2 volts).

Transistor Q16, biased by the power supply voltage VDD and current source I1, prevents a parasitic PNP transistor formed by the base, collector and P-substrate of transistor Q6 from turning on during circuit startup with a low power supply ramp rate.

The resulting output voltage at the drain electrode of transistor M15 is driving the output stage formed by transistors M23, M1 and Q4, and resistor R6. Diode-connected PMOS transistor M0, biased by a current source I2, provides a gate drive voltage level-shifted down from the power supply voltage VDD for output transistor M1.

A second voltage clamp circuit in the form of diode-connected PMOS transistors M27, M26, M25 and M57 clamp the maximum voltage Vds across the drain and source electrodes of output transistor M23 to prevent it from exceeding its maximum operating voltage (e.g., <1.8 volt). Further, the biasing action of transistor M1 maintains a substantially constant drain-to-source voltage VDS across transistor M23, thereby preventing channel modulation.

Diode-connected transistor Q4 and resistor R6 serve as the output load for output transistor M23, and simulate the serial connection of transistors Q6 and Q7 and resistors R1, R2 and R0. This provides matching for the respective loads of current mirror transistors M12 and M15, and output transistor M23.

The resulting bandgap reference voltage VBG is provided at the base electrodes of transistors Q6 and Q7.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including bandgap voltage reference circuitry, comprising:

first and second power supply electrodes to convey a power supply voltage;

current mirror circuitry coupled to said first power supply electrode and responsive to said power supply voltage and a first clamped voltage by providing first and second currents;

bandgap reference circuitry coupled between said current mirror circuitry and said second power supply electrode, and responsive to said power supply voltage, said first and second currents and said first clamped voltage by providing a bandgap reference voltage; and first voltage clamp circuitry coupled to said first power supply electrode, said current mirror circuitry and said bandgap reference circuitry, and responsive to said power supply voltage and said first clamped voltage by preventing said first clamped voltage from exceeding a first predetermined value.

2. The apparatus of claim 1, wherein:

said current mirror circuitry comprises a plurality of insulated gate field effect transistors having a transistor threshold voltage associated therewith; and said first predetermined value of said first clamped voltage is less than said transistor threshold voltage.

3. The apparatus of claim 1, wherein said current mirror circuitry comprises:

a first transistor coupled to said first power supply electrode and responsive to said power supply voltage by providing a bias signal and said first supply current; and a second transistor coupled to said first power supply electrode and said first transistor, and responsive to said power supply voltage and said bias signal by providing said second supply current.

4. The apparatus of claim 3, wherein:

said first and second transistors comprise first and second insulated gate field effect transistors; and said first transistor comprises a diode-connected transistor.

5. The apparatus of claim 1, wherein said bandgap reference circuitry comprises:

a first bipolar junction transistor to conduct said first current with a first emitter area; and a second bipolar junction transistor to conduct said second current with a second emitter area, wherein said second emitter area is greater than said first emitter area.

6. The apparatus of claim 5, wherein:

said first bipolar junction transistor is responsive to said bandgap reference voltage and said first clamped voltage by conducting said first current;

said second bipolar junction transistor is responsive to said bandgap reference voltage and said first clamped voltage by conducting said second current and providing an internal reference voltage; and said bandgap reference circuitry further comprises amplifier circuitry coupled to said first and second power supply electrodes and said first and second bipolar junction transistors, and responsive to said power supply voltage and said internal reference voltage by providing said bandgap reference voltage.

7. The apparatus of claim 1, wherein said bandgap reference circuitry comprises:

internal circuitry responsive to said power supply voltage, said first and second currents, said first clamped voltage and said bandgap reference voltage by providing an internal reference voltage; and amplifier circuitry coupled to said first and second power supply electrodes and said internal circuitry, and responsive to said power supply voltage and said internal reference voltage by providing said bandgap reference voltage.

8. The apparatus of claim 7, wherein:

said amplifier circuitry is responsive to said power supply voltage and said internal reference voltage, and further responsive to a second clamped voltage by providing said bandgap reference voltage;

said bandgap reference circuitry further comprises second voltage clamp circuitry coupled to said first power supply electrode and said amplifier circuitry, and responsive to said power supply voltage and said second clamped voltage by preventing said second clamped voltage from exceeding a second predetermined value.

9. The apparatus of claim 8, wherein:

said amplifier circuitry comprises a plurality of insulated gate field effect transistors having a transistor threshold voltage associated therewith; and said second predetermined value of said second clamped voltage is no greater than said transistor threshold voltage.

10. The apparatus of claim 8, wherein said second voltage clamp circuitry comprises a plurality of serially coupled diode-connected transistors.

11. The apparatus of claim 1, wherein said first voltage clamp circuitry comprises a plurality of serially coupled diode-connected transistors.

12. A method of providing a bandgap voltage reference, comprising:

generating first and second currents in response to a power supply voltage and a first clamped voltage;

generating a bandgap reference voltage in response to said power supply voltage, said first and second currents and said first clamped voltage; and preventing, in response to said power supply voltage and said first clamped voltage, said first clamped voltage from exceeding a first predetermined value.

13. The method of claim 12, wherein said preventing, in response to said power supply voltage and said first clamped voltage, said first clamped voltage from exceeding a first predetermined value comprises preventing said first clamped voltage from exceeding a transistor threshold voltage.

14. The method of claim 12, wherein:

said generating a bandgap reference voltage in response to said power supply voltage, said first and second currents and said first clamped voltage comprises generating said bandgap reference voltage further in response to a second clamped voltage; and said method further comprises preventing, in response to said power supply voltage and said second clamped voltage, said second clamped voltage from exceeding a second predetermined value.

15. The method of claim 14, wherein said preventing, in response to said power supply voltage and said second clamped voltage, said second clamped voltage from exceeding a second predetermined value comprises preventing said second clamped voltage from exceeding a transistor threshold voltage.

* * * * *